United States Patent [19]

Mitchell

[11] Patent Number: 4,612,679

[45] Date of Patent: Sep. 23, 1986

[54] BED SIDE GUARD ASSEMBLY

[75] Inventor: Larry D. Mitchell, Manchester, Mo.

[73] Assignee: Amedco Health Care Inc., St. Louis, Mo.

[21] Appl. No.: 584,981

[22] Filed: Mar. 1, 1984

[51] Int. Cl.[4] ..... A47C 21/08; A47C 21/00

[52] U.S. Cl. ..... 5/425; 5/428; 5/430; 5/508

[58] Field of Search ..... 5/100, 425, 427–430, 5/508; 297/417

[56] References Cited

U.S. PATENT DOCUMENTS

| | | | |
|---|---|---|---|
| 2,817,855 | 12/1957 | Pratt | 5/430 |
| 3,932,903 | 1/1976 | Adams et al. | 5/100 |
| 4,183,015 | 1/1980 | Drew et al. | 5/425 |
| 4,186,456 | 2/1980 | Huempfner | 5/430 |

FOREIGN PATENT DOCUMENTS

| | | | |
|---|---|---|---|
| 1006957 | 10/1965 | United Kingdom | 5/430 |

*Primary Examiner*—Gary L. Smith
*Assistant Examiner*—Michael F. Trettel
*Attorney, Agent, or Firm*—Gravely, Lieder & Woodruff

[57] ABSTRACT

A side guard for a hospital bed moves between elevated and depressed positions on parallel swing arms that are quite short and extend from a base mounted on the back section of the bed. It further has an upper section which pivots outwardly and downwardly to a retracted position to substantially reduce the height of the side guard. When the side guard is in its depressed position with its upper section folded to the retracted position, the side guard lies entirely below the mattress supporting surface of the bed back section and therefore does not interfere with bed making. Also the upper section may carry a bed control unit, or a telephone, or controls for other electrically operated devices, and when in its extended position, these devices are presented inwardly toward the occupant of the bed, but when the upper section is in its retracted position, they are presented outwardly where they are conveniently accessible to one sitting or standing beside the bed. The parallel swing arms have spindles which project into the base where they rotate as the side guard moves between its elevated and depressed positions, and those spindles carry crank arms that are connected by a tie bar. A latch bolt lies in the path of the tie bar to hold the side guard in its elevated position. Moreover, the tie bar, by coming against one or the other of the spindles, prevents the side guard from going past its elevated or depressed positions.

9 Claims, 9 Drawing Figures

FIG. 2
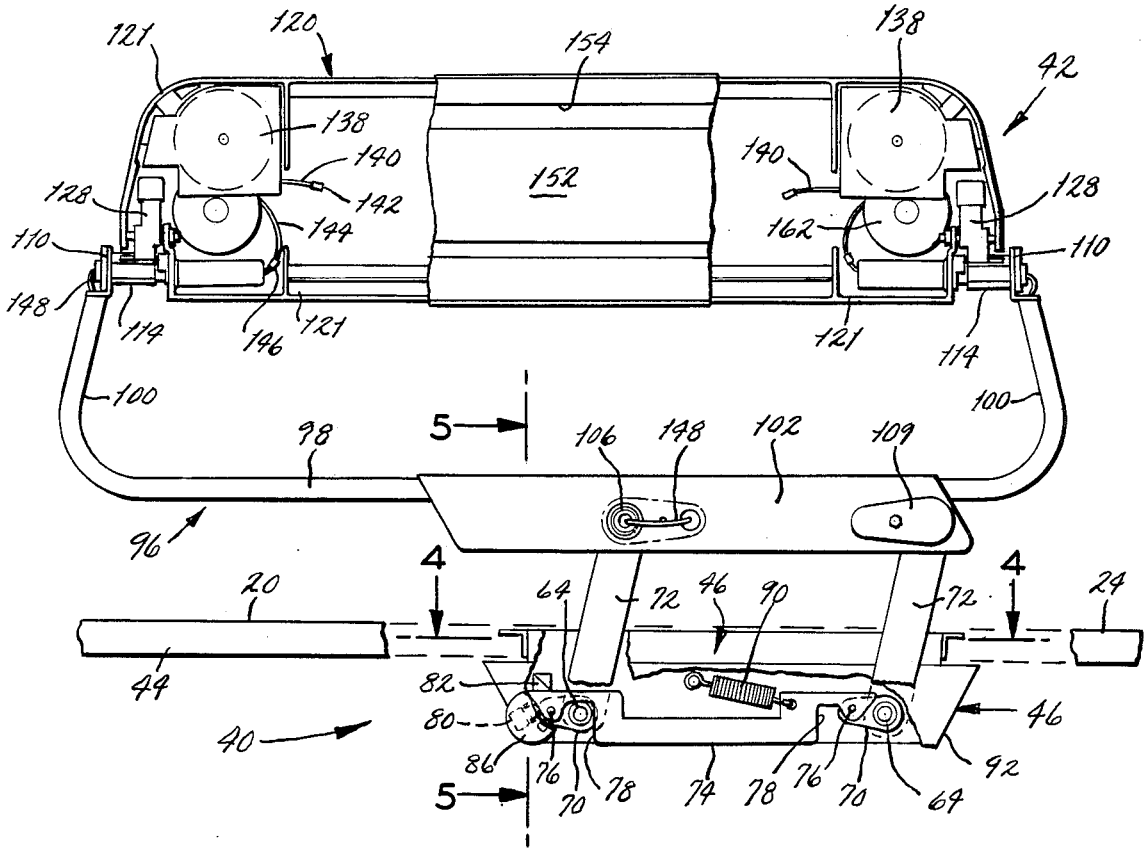
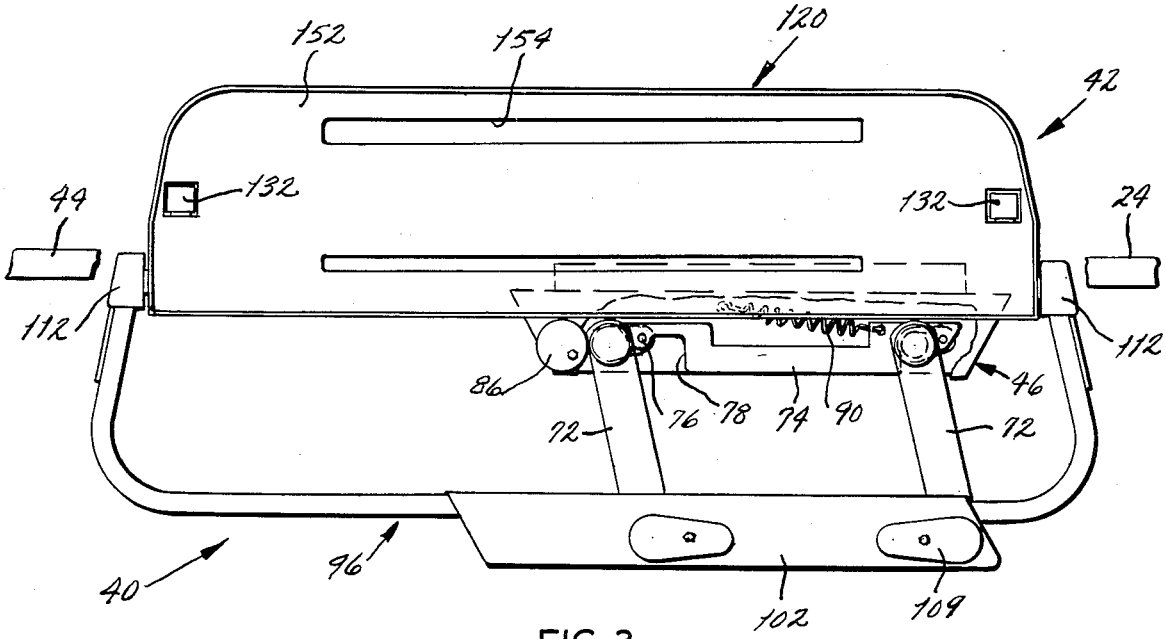
FIG. 3

FIG. 4
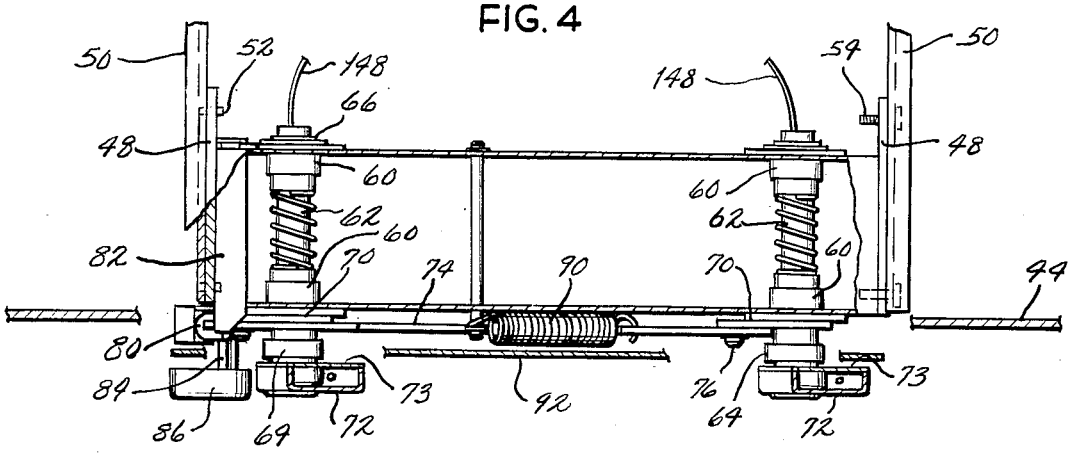
FIG. 5
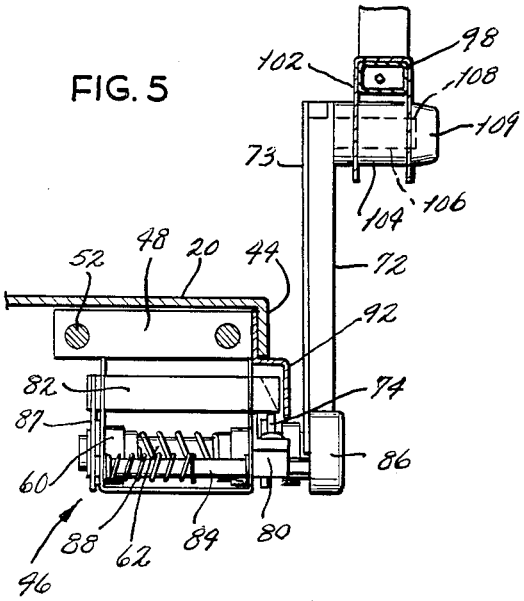
FIG. 6
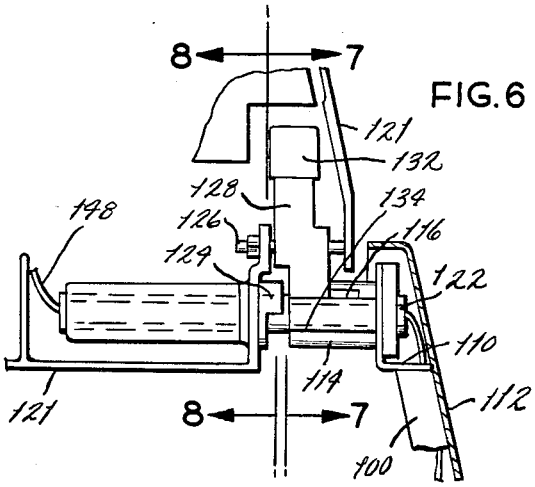
FIG. 7
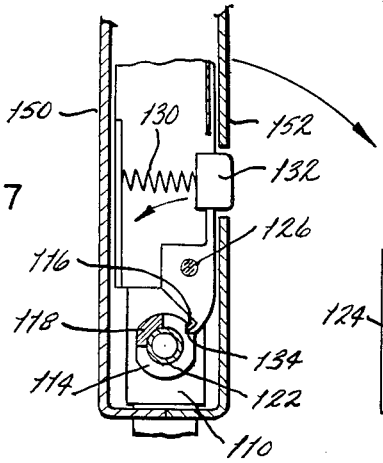
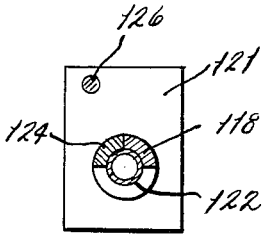
FIG. 8
FIG. 9
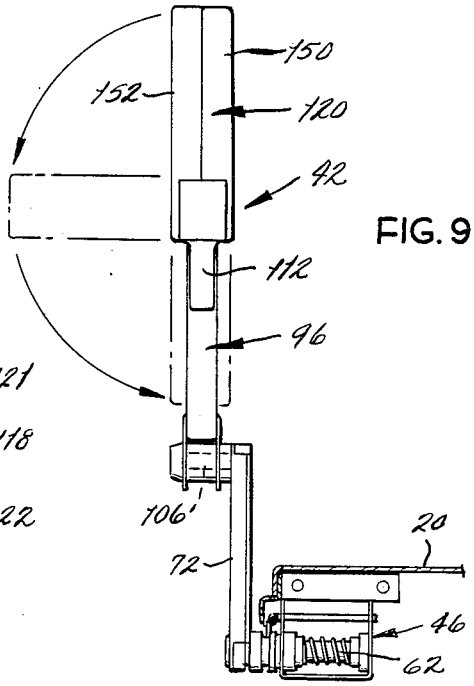

BED SIDE GUARD ASSEMBLY

BACKGROUND OF THE INVENTION

This invention relates in general to beds, such as hospital and nursing home beds, and more particularly to side guards for such beds.

The typical hospital bed is provided along each of its sides with a side guard which moves between upper and lower positions. When in the upper position, the side guard projects above the upper surface of the mattress and prevents the occupant of the bed from rolling or otherwise falling out of the bed. Thus, a sedated or feeble patient may be left unattended with some assurance that the raised side guards will keep that person in the bed. On the other hand, when the side guard is in its lower position, it is below the upper surface of the mattress, and this enables the occupant to get into or out of the bed with relative ease. It also does not interfere with those who attend to the patient. Indeed, the side guard should drop slightly below the pan surface on which the mattress rests, for then it will not interfere with bed making chores.

Parallel links or arms constitute one arrangement for supporting a side guard so that it will move easily between the two positions. In this arrangement two parallel arms extend between the side guard and the movable back section on which the head end of the mattress rests, those links being of equal length and rotatably connected to both the side guard and at the back section. Thus, the side guard moves upwardly or downwardly when the links rotate, yet remains at the same angle with respect to the back section. In order to enable the side guard to rise high enough to be effective in its purpose, and still drop low enough so as not to interfere with the changing of sheets or the replacement of a mattress, the two parallel arms must be quite long. This, however, detracts from the stability of the side guard, making it somewhat wobbly in its upper position. It further causes the side guard to undergo a lengthy translational movement when passing between the two positions, and this requires considerable clearance at the end of the side guard.

Aside from the foregoing problems, the practice of installing bed controls and controls for other electrical devices on the side guards of a bed, while making those devices more convenient for a patient who is actually in the bed, has just the opposite effect for those who are standing or seated beside the bed. The common pendant control merely rests on a mattress and may be moved about and operated with about as much convenience to the bed-ridden patient as those beside the bed. However, this convenience is more than offset by the tendency of the control to fall off of the bed or for the wire leading to the control to become entangled in mechanisms of the bed. The more recent side guard controls do not have these problems, but nevertheless are not easily seen or manipulated from outside the bed. Thus, a patient sitting in a chair near the bed, or a visitor or attendant standing beside the bed, has difficulty operating the side guard controls.

SUMMARY OF THE INVENTION

One of the principal objects of the present invention is to provide a side guard which moves between its elevated and depressed positions on parallel links that are relatively short. Another object is to provide a side guard of the type stated that is rigidly presented on the bed when in its upper position. A further object is to provide a side guard of the type stated that does not require a large clearance along the bed to accommodate the translational movement that accompanies the change from its elevated to its depressed positions or vice-versa. An additional object is to provide a side guard of the type stated which, when in its depressed position, normally projects above the pan surface on which the mattress is supported along the back section of the bed, yet may be lowered still further without undergoing further translation so as to place it entirely below the pan surface, in which position it does not interfere with efforts to change bedding. Still another object is to provide a side guard of the type stated on which bed controls are mounted, with the side guard being configured and arranged to present the controls either inwardly toward an occupant of the bed or outwardly toward one who is beside the bed, so that either may see and easily manipulate such controls. Yet another object is to provide a hospital or similar type bed having a side guard of the type stated. An additional object is to provide a novel parallel linkage arrangement for supporting the side guard. These and other objects and advantages will become apparent hereinafter.

DESCRIPTION OF THE DRAWINGS

In the accompanying drawings which form part of the specification and wherein like numerals and letters refer to like parts wherever they occur—

FIG. 2 is a side elevational view of the side guard assembly in its elevated position and extended configuration and further showing various components of the assembly broken away to better illustrate components otherwise obscured by them;

FIG. 3 is a side elevational view of the side guard assembly in its depressed position with its side guard still in the extended configuration;

FIG. 4 is a sectional view taken along line 4—4 of FIG. 2 and essentially showing the base of the side guard assembly;

FIG. 5 is a sectional view taken along line 5—5 of FIG. 2 and illustrating the latching mechanism for the side guard assembly;

FIG. 6 is an enlarged side elevational view of one of the pivot connections between the upper and lower sections of the side guard;

FIG. 7 is a sectional view taken along line 7—7 of FIG. 6 and showing a locking dog for holding the upper section of the side guard in its extended position;

FIG. 8 is a sectional view taken along line 8—8 of FIG. 6 and showing the lugs for limiting the swinging movement of the upper section of the side guard on the lower section; and FIG. 9 is an end elevational view of the side guard assembly showing in phantom lines the upper section of the side guard folding into its retracted position.

DETAILED DESCRIPTION

Figure 1:
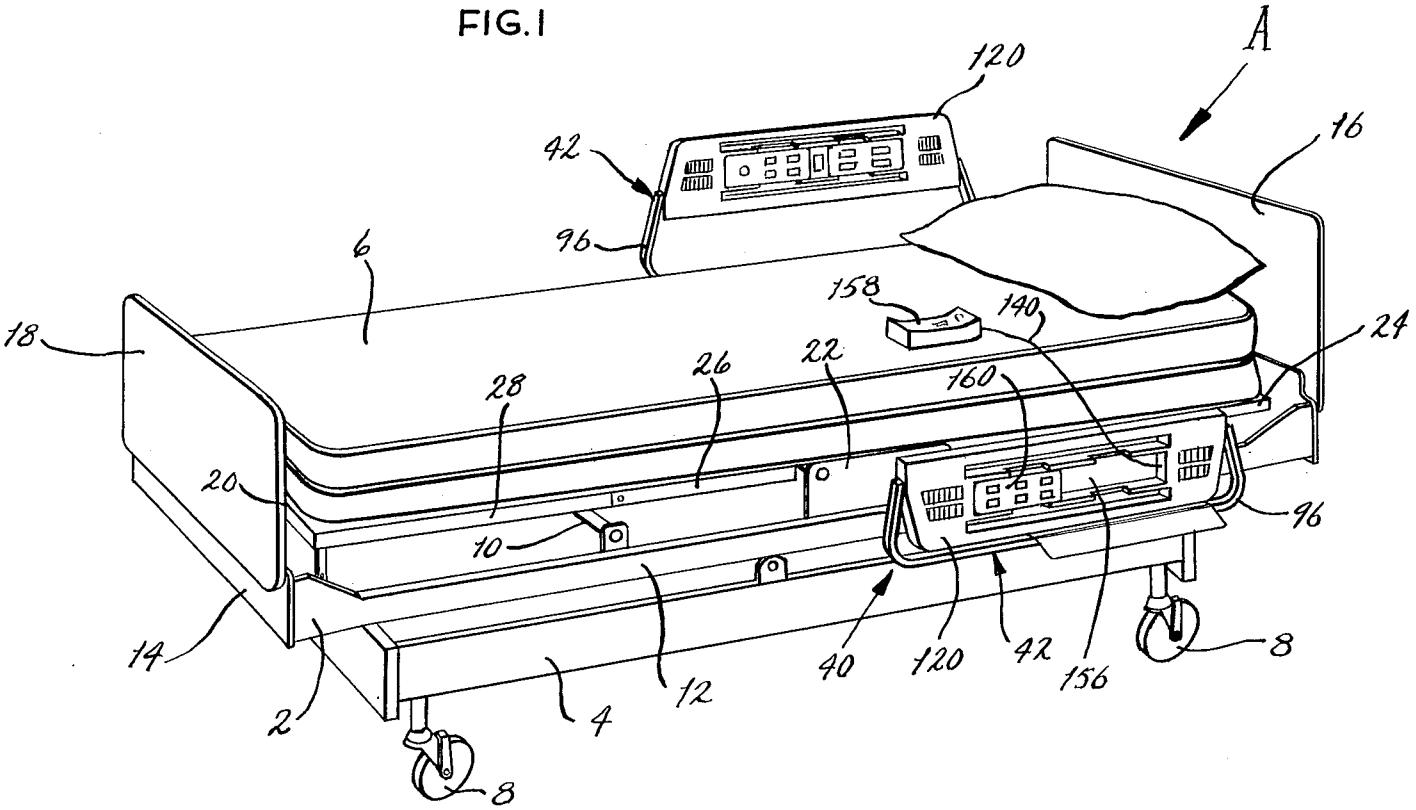
FIG. 1 is a perspective view of a hospital bed provided with side guard assemblies constructed in accordance with and embodying the present invention, the side guard assembly on the right side of the bed being in its elevated position and extended configuration and the side guard assembly on the left side of the bed being in its depressed position and retracted configuration.

Referring now to the drawings, a hospital bed A (FIG. 1) has an upper frame 2 and a lower frame 4, the former of which carries a mattress 6, while the latter has casters 8 which enable the bed A to be easily moved over a floor. Extended between the upper and lower frames 2 and 4 is an elevating mechanism 10 which not only supports the upper frame 2 over the lower frame 4, but also controls the elevation at which the upper frame 2 is supported. Indeed, the elevating mechanism 10 adjusts each end of the upper frame 2 independently of the other so that the elevating mechanism 10 also controls the inclination of the upper frame 2. A suitable elevating mechanism forms the subject of U.S. Pat. Nos. 4,425,673 and 4,425,674.

The upper frame 2 includes a pair of side rails 12 and cross members 14 which extend between the side rails 12. One of the cross members 14 is at the end of the frame 2 and a head board 16 is bolted to this member. Another of the cross members 14 is at the foot end of the frame 2 and to this member a foot board 18 is attached. Normally the head board 16 and foot board 18 project above the upper surface of the mattress 6.

Actually, the mattress 6 does not rest directly on the upper frame 2, but instead on a so-called pan 20 (FIG. 1) which is in turn carried by the upper frame 2. The pan 20 includes a seat section 22 located generally midway between the ends of the frame 2, a back section 24 located between the seat section 22 and the head board 16 and a thigh section 26 and a foot section 28 arranged in that order between the seat section 22, and the foot board 18. The four sections 22, 24, 26, and 28 are equal in width, and that corresponds to or is slightly greater than the spacing between the two side rails 12 of the upper frame 2. Moreover, each section 22, 24, 26, and 28 has a flat upwardly presented surface, and it is these surfaces on which the mattres 6 rests. The seat section 22 is positioned firmly on the upper frame 2, and as such does not move relative to that frame. The back section 24 pivots relative to the seat section 22 about a transverse axis located along the forward edge of the seat section 22, so that the back section 24 may swing upwardly on the upper frame 2. The thigh section 26, on the other hand, pivots about a transverse axis located along the rear edge of the seat section 22, while the foot section 28 pivots about a transverse axis located along the rear edge of the thigh section 26. The rear edge of the foot section 28 rests on tracks located on the side rails 12. Thus, when the thigh section 26 swings upwardly, it brings the adjacent end of the foot section 28 upwardly and draws the entire foot section 28 forwardly along its tracks. The elevating mechanism 10 which controls the elevation and inclination of the upper frame 2 also moves the back section 24 and the thigh section 26, controlling the inclination of each of them relative to the upper frame 2. The mattress 6, being supported on the four sections 22, 24, 26, and 28 of the pan 20 assumes the various inclinations of those sections.

To prevent an occupant of the bed A from rolling or otherwise falling off of the mattress 6 and onto the floor, the bed A is provided with side guard assemblies 40 (FIG. 1) along the back section 24 of its pan 20, and each of these assemblies includes a side guard 42 which moves between an elevated position (FIG. 2) and a depressed position (FIG. 3). In the elevated position the side guard 42 projects substantially above the upper surface of the mattress 6 and creates a barrier along the side of the mattress 6. In the depressed position the side guard 42 lies below the upper surface of the mattress 6 and does not inhibit one from either entering or leaving the bed A.

The two side guard assemblies 40 are actually carried by the pan 20, and more particularly by the back section 24 of the pan 20, which section has a flange 44 along each of its side edges. Aside from its side guard 42, each side guard assembly 40 includes a base 46 (FIGS. 4 & 5) which lies along the inside of one of the flanges 44 for the back section 24, yet projects below that flange. The base 46 is actually a tubular member having mounting brackets 48 at each of its ends, and each of these brackets is provided with a pair of apertures. The base 46 fits between a pair of lateral mounting pieces 50 (FIG. 4) on the underside of the back section 24, these pieces being spaced apart a distance only slightly greater than the length of the base 46 so that the lateral pieces 50 confine the base 44, at least in the longitudinal direction. The one lateral piece has fixed pins 52 projected toward the other lateral piece 50, and these pins align with and project into the apertures in one of the brackets 48 on the base 44. The other lateral piece 50 has screws 54 threaded into it, and these screws, while being directed toward the lateral piece 50 with the pins 52, may be backed off so as to enable the base 44 once its one bracket 48 is engaged with the pins 52, to be swung upwardly to a position in which the screw 54 align with the apertures in the other bracket 48. Thereupon the screws 54 are turned down and enter the apertures in the adjacent bracket 48, thus securing the base 44 in a fixed position on the back section 24.

The base 46 near each of its ends is fitted with bushings 60 (FIGS. 4 & 5) which are presented below the flange 44 for the back section 24 and arranged in pairs, there being one bushing of each pair in one of the side walls of the tubular base 46 and the other in the opposite side wall. Moreover, the bushings 60 of each pair are axially aligned, and the axes of two pairs of bushings 60 are parallel and transverse to the back section 24. Extended through the bushings 60 of each pair is a hollow spindle 62, which beyond the outwardly presented wall of the base 46 is fitted with a hub 64 and at the inwardly presented wall with a snap ring 66. The hub 64 and ring 66 of each spindle 62 prevent that spindle 62 from moving transversely, that is axially, but do not impede it from rotating within its bushings 60.

Each hub 64 includes a short crank arm 70 (FIG. 2) and a substantially longer swing arm 72 which are offset about 90° with respect to each other. The swing arms 72 for the two spindles 60 are presented beyond the sides of the pan back section 24 where they connect with the actual side guard 42, the spacing between the connections being equal to the spacing between the two spindles 60 so that the two swing arms 72 remain parallel irrespective of their angular positions. Thus, the two swing arms 72 together with the base 46 and side guard 42 produce a parallel linkage arrangement. When the side guard 42 is in its elevated position (FIG. 2), the swing arms 72 project upwardly from the back section 24, being slightly offset from the perpendicular so as to be inclined somewhat toward the free or head end of the back section 24. When in the depressed position (FIG. 3), the swing arms 72 are likewise slightly off of the perpendicular and inclined somewhat toward the head end of the section 24, but they project downwardly instead of upwardly. Thus, the swing arms 72 rotate almost 180° when the side guard 42 moves between its elevated position and its depressed position. The swing arms 72 are channel-shaped in cross-section, with the channels opening inwardly to the base 46 and being closed by cover plates 73 (FIGS. 4 & 5). The channels at their ends open into the hollow interiors of the spindles 62.

The two crank arms 70 likewise remain parallel, and are connected by a tie bar 74 (FIGS. 2–4) each end of the tie bar 74 being attached to one of the crank arms 70 at a pivot pin 76. Near each of its ends the tie bar 74 is provided with downwardly opening cutouts 78. When the side guard 42 is in its elevated position (FIG. 2), the two crank arms 70 project rearwardly at an angle with respect to a plane defined by the axis of the two spindles 62, and the tie bar 74 is presented rearwardly with its rear cutout 78 receiving the hub 64 on the rear spindle 62. Indeed, the upper and side margins of the cutout 78 bear against the cylindrical portion of the hub 64 that is between crank arm 70 and swing arm 72 on that hub. Moreover, the tie bar 74 extends rearwardly somewhat beyond the pivot pin 76 at the forward crank arm 70, and bears against a stop 80 which may have a rubber surface to cushion the entry of the side guard 42 into its elevated position.

The side guard 42 is retained or secured in its elevated position by a latch bolt 82 (FIGS. 4 & 5) which projects from the tubular base 46 and overlies tie bar 74 in the vicinity of its rear pivot pin 76. This prevents the crank arm 70 on the forward hub 64 from swinging upwardly, and this in turn prevents the spindles 62 from rotating so the swing arms 72 cannot revolve and move the side guard 42 to its depressed position. The latch bolt 82 extends completely through the base 46, and is further capable of sliding with respect to the base 46, so that its outer end may be retracted enough to clear the rear end of the tie bar 74. This, of course, frees the tie bar 74 so that the rear crank arm 70 can swing upwardly, as will occur when the swing arms 72 move the side guard 42 to its depressed position. Moreover, the projecting end of the latch bolt 82 is beveled (FIG. 4), with the beveled face being presented forwardly and outwardly so that it will be in the path of the rear end of the tie bar 74 as the side guard 42 moves to its elevated position. Thus, as the tie bar 74 approaches its rearmost position, its rear end contacts the beveled surface on the bolt 82 and drives the bolt 82 inwardly, holding the bolt 82 inwardly until it passes by the bolt 82, at which time the bolt 82 is free to move outwardly where the bolt 82 again lies in the path of the tie bar 74 and prevents the bar 74 from rising.

The latch bolt 82 is operated by a push rod 84 (FIG. 5) which also extends through the tubular base 46 below the bolt 82 and stop 80, its outer end being presented slightly rearwardly from the rear hub 64. Here the rod 84 is fitted with an operating knob 86. The rod 84 is connected with the latch bolt 82 through a short connecting arm 87, so that the bolt 82 and rod 84 slide in unison. Moreover, the portion of the push rod 84 that is within the hollow interior of the base 46 is fitted with a spring 88 that urges the rod 84 outwardly, that is to the position in which its knob 86 is presented farthest from base 46. When the push rod 84 assumes this position, the beveled end of the latch bolt 82 is located in the path of the tie bar 74.

The downwardly opening cutout 78 at the opposite end of the tie rod 74, that is at the forward end, is presented away from nearby spindle hub 64 when the side guard 42 is in its elevated position (FIG. 2), but receives the hub 64 when the side guard 42 is in its depressed position (FIG. 3). Indeed, the side and upper edges of the cutout 78 contact the portion of the hub 64 between the crank arm 70 and the swing arm 72, once the side guard reaches its lower position, and prevent the swing arms 72 from moving any further.

Extended between the base 46 and the tie bar 74 is a coil-type tension spring 90 (FIGS. 2–4) which, by exerting a force on the tie bar 74, urges the side guard 42 to its elevated position. To a measure the spring 90 counterbalances the side guard 42, so that relatively little effort is required to lift it from its depressed position to its elevated position.

While the tie bar 74, the crank arms 70 to which they attach, the beveled end of the latch bolt 82, and the spring 90 are all located beyond the outwardly presented face of the base 46, they are not exposed and do not present any danger. Instead they are concealed by a cover plate 92 (FIGS. 4 & 5) which is attached to the base 46 and precludes access to them. The operating knob 86, however, is exposed so that it may be depressed to retract the latch bolt 82.

Turning now to the side guard 42 itself, it includes a lower section 96 (FIG. 2) having a straight intermediate portion 98 of substantial length, and turned up legs 100 at its ends. The legs 100 are slightly convergent, and are formed integral with the intermediate portion 98, all being tubular. Wrapped over and welded to the intermediate portion 98 is a mounting bracket 102 having downwardly directed flanges through which metal bushings 104 (FIG. 5) are fitted. The spacing between the bushings 104 equals the spacing between the two pairs of bushings 60 in the base 46, and indeed the opposite ends of the swing arms 72 have short spindles 106 which project outwardly from them and into the bushings 104. The spindles 106 are parallel to the spindles 62, and the bushings 60 of the side guards 42 are retained on the swing arms 72 by snap rings 108 which are fitted to the spindles 106. Here the open ends of the spindles are concealed by caps 109 (FIGS. 2 & 5) which are attached to the outside flange of the mounting bracket 102.

Welded to the upper ends of the legs 100 for the lower section 96 are short upwardly directed brackets 110 (FIG. 2) which are totally concealed at the ends of the side guard 42 by covers 112 (FIG. 3) that are fastened to the legs 100. The brackets 110 have pivot members or sleeves 114 (FIGS. 2 & 6) attached firmly to them with machine screws, each sleeve 114 projecting inwardly from its bracket 110 toward the other sleeve 114. Indeed, the two sleeves 114 lie along the same axis, and that axis extends generally longitudinally with respect to the bed and parallel to the intermediate portion 98 of the lower member 96. Each sleeve 114 on its outside surface has an axially directed groove 116 (FIGS. 6 & 7) which opens generally upwardly. Actually, each groove 116 is V-shaped in cross-section, its one surface being vertical and its other horizontal. On its side opposite from the groove 116 each sleeve 114 has a stop lug 118 (FIGS. 7 & 8) which projects axially toward the other pivot sleeve 114.

In addition to its lower section 96, the side guard 42 includes an upper section 120 which is mounted on the pivot sleeves 114 of the lower section such that it can swing or pivot between an extended position (FIG. 1—right side of bed), wherein it projects upwardly from and forms a continuation of the lower section 96, and a retracted or folded position (FIG. 1—left side of bed), wherein it, in effect, fits within the lower section 96. The upper member 120 has a die cast frame 121 (FIG. 2), the lower portion of which fits between the two pivot sleeves 114 on the lower section 96. Here the frame 121 is fitted with tubular trunnions 122 (FIG. 6) which project into the sleeves 114 and enable the upper section 120 to pivot relative to the lower section 96 about the common axis of the two sleeves 114. In the region of the sleeves 114, the frame 121 has stop lugs 124 (FIGS. 6 & 8) which lie along the trunnions 122 and abut the end faces of the pivot sleeve 114, but are offset angularly from the lugs 118 on the sleeves 114. The lugs 118 and 124 along each trunnion 122 together occupy about 180° around the trunnion 122 and are positioned such that, when the upper member 120 is in its extended position, its lug 124 abuts one surface on the sleeve lug 118 (FIG. 8) and when it is in its retracted position, its lug 118 abuts the opposite surface on the sleeve lug 118. Thus, the lugs 124 prevent the upper section 120 from falling downwardly toward the mattress 6, when the upper section 120 is in its extended position, and likewise prevent the upper section 120 from being pushed inwardly, when the section 120 is in its retracted position. The lugs 118 and 124, however, do not prevent the upper section 120 from swinging outwardly when moving between its extended and retracted positions.

Portions of the frame 121 for the upper section 120 project axially along the pivot sleeves 114 on the lower section 96, and when the upper section 120 is in its extended position, these portions overlie the pivot sleeves 114 (FIG. 2). In these regions, the frame 121 of the upper section 120 is provided with short pivot pins 126 (FIGS. 6 & 7) which lie parallel to the common axis of the trunnions 122, and on each pin 126 is holding dog 128 having an edge which is urged toward the nearby sleeve 114 by a spring 130. Actually, each holding dog 128 extends away from its pivot pin 126 in two directions, one toward the nearby pivot sleeve 114 and the other in the opposite direction where it lies generally in the plane of upper member 120. It is this latter portion against which the spring 130 bears, extending from that portion to a nearby surface on the frame 121. This portion of the dog 128 carries a molded plastic block 132 which serves as a push button for depressing the one end of the dog 128 and causing the opposite end to move outwardly away from the surface of the sleeve 114. That opposite end terminates at an edge 134 which extends axially, and when the upper section 120 is in its extended position, the edge 134 projects into the axial groove 116 in the sleeve 114, lying along the horizontal surface of that groove. This prevents the upper section 120 from swinging outwardly and downwardly toward its retracted position. When the upper section 120 is in its extended position, the blocks 132 on the dogs 128 are exposed along the outwardly presented face of the upper member 120, and when both of the blocks 132 are depressed, the edges 134 of their respective dogs 128 move out of the axial grooves 116 in the pivot sleeves 114 so that the dogs 128 no longer hold the upper section 120 upright in its extended position. The exertion of a slight force, causes the upper member to swing outwardly and downwardly (FIG. 9) into its retracted position (FIG. 1—left side of bed) where it lies between the two end legs 100 and above the intermediate portion 98 of the lower section 96. Of course once the upper member 120 reaches its retracted position, the stop lugs 118 and 124 come into contact and prevent the upper section 120 from swinging inwardly toward the mattress 6.

The frame 121 for the upper section 120 is for the most part open, at least in its center region, but at its ends it carries reel assemblies 138 (FIG. 2), each of which has a spring loaded reel around which an electrical cable 140 containing several leads is wound. At the end of each cable 140 is a plug 142 that is presented toward the open region in the center of the frame 121. Each reel assembly 138 has another cable 144 which comes off of the hub of its reel and connects at a plug 146 with still another cable 148 that extends concealed all the way through the side guard assembly 40, emerging from the back of one of the spindles 62 at the base 46 which, being beneath the back section 24, remains concealed. In particular, immediately beyond the plug 146, the cable 148 passes into the hollow trunnion 122 which carries it through the pivot sleeve 114 into which that trunnion projects (FIG. 2). The cable 148 emerges from the end of the trunnion 122 and passes immediately into the adjacent leg 100 of the lower section, extending through that leg 100 and into the intermediate portion 98. In the region of the intermediate portion 98 that is obscured by the bracket 102, the cable 148 passes into the space between the two flanges of the bracket 102, then through an aperture in the outer flange and immediately into one of the spindles 106 that project into the bushings 104 of the side guard 42. Since the caps 109 obscure the ends of the spindles 106, and the covers 112 enclose the ends of the trunnions 122, the cable 148 remains concealed at these transitions. The cable 148 passes out of the opposite end of the spindle 106 where it enters the channel formed by the swing arm 72 to which the spindle 106 attaches, and here it is concealed by the cover plate 73 which is attached to the back of the swing arm 72. The cable 148 then enters the lower spindle 62 to which the swing arm 72 is attached, and extends all the way through that spindle, emerging from the end of the spindle 62 that is exposed along the inside face of the base 46 for the side guard assembly 40 (FIG. 4). Of course each cable 148 extends through a different trunnion 142, leg 100, spindle 106, swing arm 72 and spindle 62, in that order, and thus the two cables 148 remain totally separated. Beyond the side guard assembly, the one cable 148 may connect with the circuitry that controls the elevating mechanism 10 for the bed A, while another may connect with a telephone.

In this regard, the upper section 120 also has two cover plates 150 and 152 (FIG. 9) which fit over the frame 121 and totally conceal it, the former being presented inwardly and the latter outwardly when the upper section 120 is in its extended position. The two cover plates 150 and 152 have slots 154 (FIG. 3) which register and extend longitudinally near their free margins, that is near the margins remote from the pivot axis, and these slots provide a convenient place to grip the upper section 120. Moreover, the outside cover plate 152 has apertures through which the blocks 132 that operate the holding dogs 128 are exposed. The inside cover plate 150, on the other hand, has two relatively deep pockets 156 (FIG. 1) which are located end-to-end between the two reel assemblies 138, and at the ends of the pockets 156, the plugs 142 on the retractable cables 140 of the reel assemblies 138 are exposed. The plug 142 for the reel assembly 138 that is connected with a telephone circuit is plugged into a compact telephone 158 which snaps into the pocket 156 at that plug. To make or receive a telephone call, one merely need remove the telephone 158 from its pocket 156, in which case the cable 148 attached to it pays off of the reel assembly 138.

The plug for the reel assembly 138 that is connected to the elevating mechanism for the bed A is connected with a bed control unit 160 (FIG. 1) that has switches for controlling the elevating mechanism 10, and that unit snaps into the pocket 156 through which that other plug 142 is exposed. The switches on the unit 160 may be operated while the unit 16 is in its pocket 156, or the unit 156 may be removed and the switches operated from a remote location. Of course as the unit 156 is removed, the retractable cable 140 pays out of the reel assembly 138 to which it is attached.

Since the bed A has two side guard assemblies 40, four independent paths extend upwardly through those assemblies to the region of the bed occupant. While the upper section 120 of one side guard assembly 40 may hold a telephone 158 and a control unit 160 for the elevating mechanism 10, thus taking two of the paths, the pockets 154 in the upper section 120 of the other side guard assembly 40 may contain a unit having controls for a television or radio, while the other may contain a nurses call button or controls for lights. Indeed, these controls may be built into the inside cover plate 150 such that they cannot be removed, in which case the reel assemblies 138 are not needed.

The upper section for either one of the side guard assemblies may also carry a speaker 162 (FIG. 2) in the region of its reel assemblies 138. Actually the speaker 162 is fastened to the frame 121 of the upper section 120 and the inside cover plate 150 has apertures through which sound from the speaker 162 is emitted.

OPERATION

The two side guard assemblies 40 are capable of assuming several positions or configurations, each of which has a particular function. Of course, when the side guard 42 is in its elevated position with its upper section 120 extended (FIG. 1, right, & FIG. 2), the side guard 42 serves its primary function, that is preventing a feeble or sedated patient from rolling or otherwise falling out of the bed A. In this regard, both the lower and upper sections 96 and 120 of the side guard 42 are disposed above the mattress 6 when the side guard is in the foregoing position and configuration and as such present a barrier alongside the mattress 6 to prevent the patient from leaving the bed at that side of the mattress. The side guard assembly 40, being attached to the back section 24 of the mattress supporting pan 20, moves upwardly and downwardly with the upper frame 2 and further follows the back section 24 as its inclination is changed relative to the upper frame 2. Thus, once the side guard 42 is placed in its elevated position with its upper section 120 extended, it remains in the same position with respect to the mattress irrespective of whatever changes in elevation or inclination the mattress 6 undergoes.

Should it be desired to remove the patient from the bed or to allow him to leave the bed on his own volition, an attendant need only press the operating knob 86 that is exposed along the base 46 of one of the side guard assemblies 40. This retracts the latch bolt 82 and frees the tie bar 74 so that the tie bar 74 can swing upwardly and forwardly on the crank arms 70 at its two ends. Indeed, the weight of the side guard 42 is enough to cause the side guard 42 to swing downwardly on its swing arms 72, in which case the tie bar 74 moves upwardly and then forwardly. The movement continues until the cutout 78 at the forward end of the tie bar 74 settles around the hub 64 on the forward spindle 62. When the margins of this cutout 78 come against the hub 64, the motion stops and the swing arms 72 extend generally perpendicularly from the back section 24 of the pan 20 (FIG. 3). In this position of the swing arms 72 the upper margin of the extended upper section 120 for the side guard 42 is below the top surface of the mattress 6 and does not inhibit one from either leaving the bed or entering it.

Even though the side guard 42 when in the foregoing position and configuration does not in any way obstruct ingress or egress, it does interfere with attendants who must make the bed A, for the upper section 120 of the side guard 42 is still along the side of the mattress. However, this obstruction is easily eliminated by folding the upper section 120 from its extended to its folded or retracted position (FIG. 1, left). In particular, the attendant merely depresses the two blocks 132 that are exposed through the outer cover plate 152 on the upper section 120, and this withdraws the dogs 128 from the axial grooves 116 in the pivot sleeves 114 (FIG. 7). This in turn frees the upper section 120 so that it may swing outwardly and then downwardly (FIG. 9) into its retracted position where it is in essence nested with respect to the lower section 98, that is, it is between the two end legs 100 of the lower section 96 and in essentially the same plane as the lower section 96. When so disposed the upper section 120 projects no higher than the lower section 96 and is at about the elevation of the pan surface for the back section 24 on which the matress 6 rests. Hence the full side of the mattress 6 is exposed and the attendant encounters no difficulty tucking sheets under the mattress or attending to other matters.

Often a chair is located next to a hospital bed for the convenience of the patient, should the patient desire to spend some time sitting instead of lying in the bed A. Indeed, the sitting hours are often spent reading or watching television. Should the television controls be in a control unit that is contained in one of the pockets 156 of the upper section 120 for the side guard 42, that control unit may be rendered easily accessible to a patient merely by bringing the upper section 120 to its folded configuration while leaving the side guard 42 itself in its elevated position, that is the position in which the swing arms 72 extend upwardly along the side of the mattress 6. The same holds true with regard to the telephone 158. Similarly, visitors or attendants may more easily use the television control unit or bed control unit 160 or the telephone 158 by folding the upper sections 120 on which it is located outwardly so that it is presented away from the patient and toward the visitor or attendant.

Since the side guard 42 in effect folds in half to bring it below the mattress 6, the swing arms 72 are considerably shorter than the swing arms 72 on conventional side guards, and therefore they do not require substantial clearance to accommodate the translational movement. Also, they do not come nearly as close to the floor and thus do not interfere with objects that may be placed under the bed. Furthermore, being quite short, the swing arms 72 impart considerable rigidity to the side guard 42, irrespective of whether it is in its upper or lower position.

To provide further protection, additional side guard assemblies 40 may be installed on the foot section 28 or thigh section 26 of the upper frame 2, although these side guard assemblies would not have control units for electrical devices.

This invention is intended to cover all changes and modifications of the example of the invention herein chosen for purposes of the disclosure which do not constitute departures from the spirit and scope of the invention.

What is claimed is:

1. A side guard assembly for presenting a barrier along the side of a bed to prevent an occupant of the bed from rolling or otherwise falling out of the bed, said side guard assembly comprising a base; a pair of swing arms mounted on the base for rotation about parallel first axes; a lower side guard section attached to and supported on the swing arms remote from the first axes such that the swing arms rotate relative to the lower side guard section at parallel second axes which are parallel to the first axes, whereby a parallel linkage arrangement is established that enables the lower side guard to move between an elevated position and a depressed position in a plane that is perpendicular to the first and second axes; and an upper side guard section mounted on the lower side guard section for movement between extended and retracted positions, the upper section when in its extended position extending above the lower section, the upper section when in its lower position extending substantially no higher than the lower section and being contained generally within the lower section.

2. A side guard assembly according to claim 1 wherein the upper section, in moving between its extended and retracted positions, pivots about an axis that is parallel to the plane of movement for the side guard when the side guard moves on its swing arms between its elevated and depressed positions.

3. A side guard according to claim 2 wherein the lower section is generally U-shaped, having upwardly presented legs at its ends; wherein a pivot member is mounted on each leg at the upper end thereof along the axis at which the upper section pivots relative to the lower section, at least one of the pivot members having an axially directed groove which opens out of the outer surface of that pivot member; and wherein a dog is mounted on the upper section and is capable of engaging the pivot member at the groove therein when the upper section is in its extended position, so as to hold the upper section in its extended position.

4. A side guard assembly according to claim 3 wherein the upper section includes trunnions which project into the pivot members.

5. In combination with a bed having a surface for supporting a mattress, an improved side guard assembly for presenting a barrier along the upper surface of the mattress to prevent an occupant of the bed from rolling or otherwise falling off of the mattress, said side guard assembly comprising: a base located on the bed; a side guard located to the side of the mattress-supporting surface and having a first section and a second section that moves relative to the first section between an extended position, wherein the side guard has one height, and a retracted position, wherein the side guard possesses less height, the second section being generally within the first section when the second section is in its retracted position; and connecting means attached to the first section of the side guard for supporting the side guard on the base and for enabling the elevation of the side guard with respect to the base to be altered.

6. The combination according to claim 5 wherein the second section pivots relative to the first section when moving between its extended and retracted positions, and further comprising means for holding the second section in its extended position.

7. A side guard assembly for presenting a barrier along the side of a bed to prevent an occupant of the bed from rolling or otherwise falling out of the bed, said side guard assembly comprising: a base; a pair of swing arms mounted on the base for rotation about parallel first axes; a side guard attached to and supported on the swing arms remote from the first axes such that the swing arms rotate relative to the side guard at parallel second axes, whereby a parallel linkage arrangement is established for enabling the side guard to move on the swing arms between elevated and depressed position; crank arms mounted in a fixed position with respect to the swing arms such that the crank arms move over center as the side guard approaches its elevated position; a tie member connecting the two crank arms, whereby the tie member moves as the side guard moves between its elevated and depressed positions, the tie member translating longitudinally and then shifting downwardly as the crank arms move over center in conjunction with the side guard coming to its elevated position; and locking means extended into the path of the tie member to prevent the tie member from moving when the side guard is in its elevated position, the locking means being retractable from the path of the tie member, the locking means comprising: a latch bolt which normally projects into the path of the tie member, but is capable of being retracted from that path, the latch bolt further having a beveled surface which is oriented such that the tie member will contact and drive the latch bolt to a nonobstructing position as the side guard moves from its depressed position into its elevated position, the latch bolt projecting over the tie member when the side guard is in its elevated position to prevent the tie member from lifting upwardly and the crank arms from moving back over center, and means for retracting the latch bolt.

8. A side guard assembly according to claim 7 and further comprising first spindles extended into the base along the first axes and having the swing arms and crank arms mounted rigidly upon them; and wherein the tie member interferes with at least at one of the spindles when the side guard is in both its elevated and its depressed positions so that movement of the side guard beyond those positions is prevented.

9. A side guard assembly according to claim 7 and further comprising a spring between the base and the tie member for applying a force to the tie member, with the force being directed to urge the side guard to its elevated position.

* * * * *